US005402973A

United States Patent [19]

Haines

[11] Patent Number: 5,402,973

[45] Date of Patent: Apr. 4, 1995

[54] PEDESTAL

[75] Inventor: John D. Haines, West Midlands, United Kingdom

[73] Assignee: Gordon Christopher Leach, Huntington, United Kingdom

[21] Appl. No.: 49,103

[22] Filed: Mar. 5, 1993

Related U.S. Application Data

[63] Continuation-in-part of Ser. No. 679,002, May 2, 1991, abandoned.

[30] Foreign Application Priority Data

Apr. 11, 1989 [GB] United Kingdom ..... 8908159

[51] Int. Cl.[6] ..... F16M 11/00

[52] U.S. Cl. ..... 248/188.7; 248/345.1

[58] Field of Search ..... 248/188.7, 188.8, 188.1, 248/158, 159, 163.1, 431, 345.1; 297/345, 349

[56] References Cited

U.S. PATENT DOCUMENTS

| | | | |
|---|---|---|---|
| 2,992,803 | 7/1961 | Good | 248/188.7 |
| 3,617,023 | 11/1971 | Schneiderman | 248/188.7 |
| 3,705,704 | 12/1972 | Textoris | 248/188.7 |
| 3,994,466 | 11/1976 | Troup | 248/188.7 X |
| 4,262,871 | 4/1981 | Kolk et al. | 248/345.1 X |
| 4,534,533 | 8/1985 | Doerner | 248/345.1 |
| 4,744,538 | 5/1988 | Hofman | 248/188.7 X |

FOREIGN PATENT DOCUMENTS

| | | | |
|---|---|---|---|
| 0636024 | 2/1962 | Canada | 248/188.7 |
| 0045151 | 2/1982 | European Pat. Off. | 248/188.7 |
| 0386832 | 9/1990 | European Pat. Off. | 248/188.7 |

OTHER PUBLICATIONS

"Function & Design in Plastic," Plako Industries, Inc. (1989/1990).

Modell 424.425, Strafor (no date).

Modell "Concentr'x" Strafor (Mar. 1985).

"Activa 434," Steelcase Strafor (no date).

*Primary Examiner*—Karen J. Chotkowski

*Attorney, Agent, or Firm*—Popham, Haik, Schnobrich & Kaufman, Ltd.

[57] ABSTRACT

A pedestal comprising a hub formed with socket for receiving an upstanding column and a plurality of arms extending radially from the socket to support said socket on a floor, said hub and said arms being a moulded one piece structure, each of said arms being hollow, being generally U-shaped in cross-section with a convexly curved bottom and having a top opening therein extending over substantially the whole length and width thereof, and separately formed cover members on top of the arms to cover said top openings.

12 Claims, 4 Drawing Sheets

FIG.1.
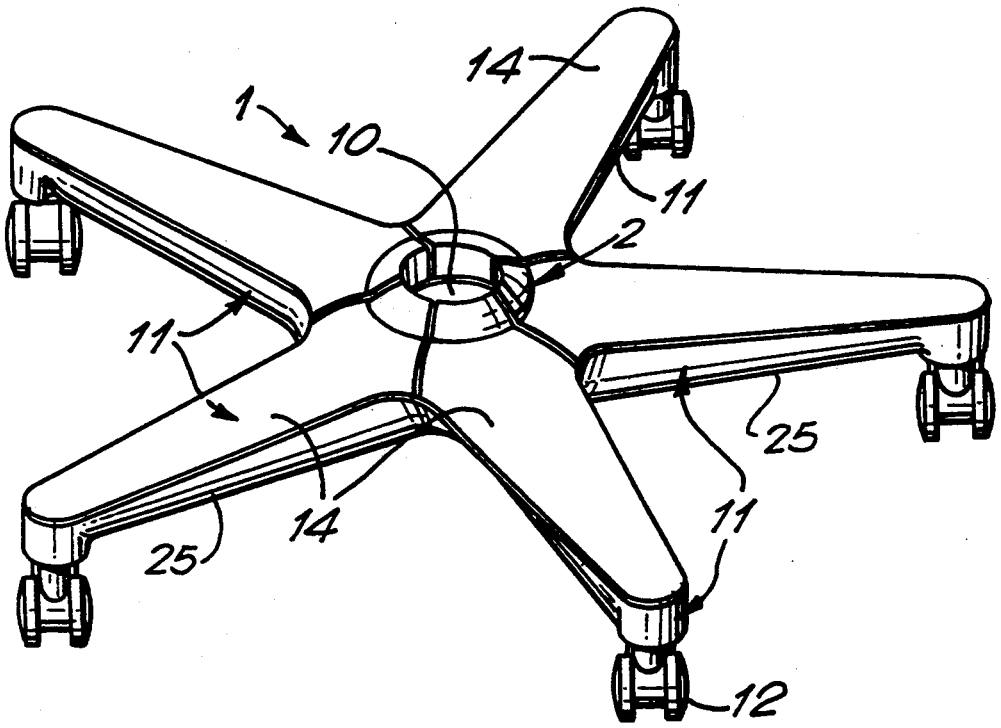
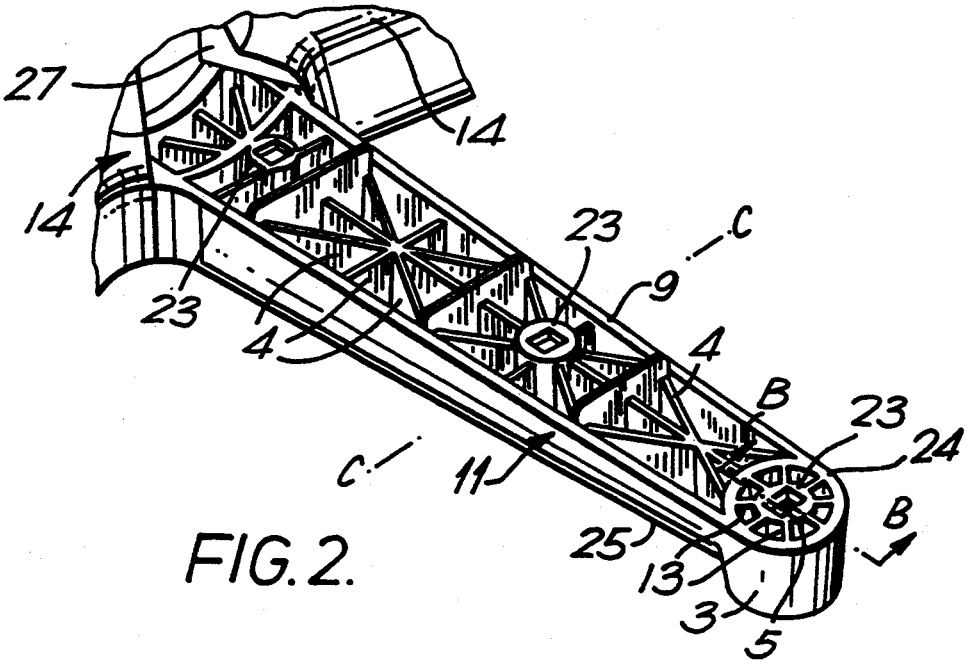
FIG.2.

PEDESTAL

DESCRIPTION

This application is a continuation-in-part of application Ser. No. 07/679,002, dated 2nd May 1991, now abandoned, in the name John Derek HAINES, assigned to Gordon Christopher LEACH.

TECHNICAL FIELD

The invention relates to pedestals and particularly, but not exclusively, to pedestals which provide bases for swivel chairs and other articles of furniture.

BACKGROUND ART

Pedestals are well known, for chairs and other articles, which comprise a central socket supported in use by arms or legs extending radially therefrom. The socket can receive an upright column (e.g. a tube or a rod) which carries the chair or other article. Such pedestals are usually made of metal, the parts being welded together, or cast in one piece. It is however known to make such pedestals as plastics mouldings, the arms, in cross section, being formed as inverted U- sections whereby the upper surfaces of the arms present a rounded appearance. Such an arrangement is described in EP 0,045,151 of Wetheralls.

It is also known from U.S. Pat. No. 3,617,023 of Schneiderman to provide a pedestal fabricated, e.g. by welding, from metal, the pedestal consisting of a centrally disposed hub and a plurality of radially extending members of channel configuration opening upwardly. A sleeve is slid onto each channel member to close the channel and the end of each sleeve is closed by a plug.

DISCLOSURE OF THE INVENTION

It is an object of the present invention to provide a pedestal, particularly for swivel chairs but which is capable of other uses, as a moulding, and which is more versatile than the known pedestals.

In particular it is an object of the invention to provide a pedestal which is visually attractive, which is adapted readily to be decorated to suit different decors, which is inherently strong and accurately produced to minimise the rocking which is often present in fabricated pedestals, and which is constructed with rounded edges to minimise shoe damage which frequently occurs particularly when a secretary hooks her shoes under a conventional chair pedestal.

According to the invention, a pedestal comprises a hub formed with socket for receiving an upstanding column and a plurality of arms extending radially from the socket to support said socket on a floor, said hub and said arms being a moulded one piece structure, each of said arms being hollow, being generally U-shaped in cross-section with a convexly curved bottom and having a top opening therein extending over substantially the whole length and width thereof, and separately formed cover members on top of the arms to cover said top openings. Preferably the cover members are co-extensive with the tops of the arms.

The cover members may comprise a top portion and a pair of sides extending downwardly from the top portion, the junctions between the top portion and the pair of sides being convexly curved, and the lower edges of the sides of the cover member defining a bottom surface, wherein the said arms have an opposite pair of sides, the upper edges of which define a top surface, and wherein the bottom surfaces of the cover members and the top surfaces of the arms are co-extensive. Preferably the cover members have inner and outer ends and the inner ends of the cover members abut one with the other to cover the hub and to define together an aperture through which the upstanding column will project and snugly surrounding the upstanding column.

Advantageously the one piece structure comprising the hub and supporting arms is moulded from plastics, although it could be a metal, e.g. aluminium, casting. Preferably the cover members are also moulded from plastics.

Advantageously the pedestal comprises means for attaching said cover members to said arms. The attaching means may be in the form of resilient projections having detents extending from said cover members, and said arms having abutments engaged by said detents to hold the cover members in place.

The free ends of the arms preferably comprise formations defining recesses for receiving ground engaging castor wheels. Advantageously each formation is part cylindrical in shape and is pierced with a cylindrical socket for receiving the upstanding post of a ground engaging castor wheel assembly.

The cover members or strips may have apertures therein and upper strips may be arranged over said cover strips to produce a pleasing decorative effect.

For stability of the pedestal, there will normally be at least three supporting arms, but preferably the pedestal is provided with five arms.

The invention also provides a chair having a base in the form of a pedestal as hereinbefore defined, a column mounted in the socket and a seat secured to the top of the column.

The following is a description, by way of example, of one embodiment of the invention, with reference to the accompanying schematic drawings.

BRIEF DESCRIPTION OF DRAWINGS

FIG. 1 is a perspective view of a pedestal in accordance with the invention, the pedestal being shown fitted with castor wheels;

FIG. 2 is a scrap perspective view of an arm of the pedestal of FIG. 1, with a cover member or strip removed;

BEST MODES FOR CARRYING OUT THE INVENTION

Figure 3:
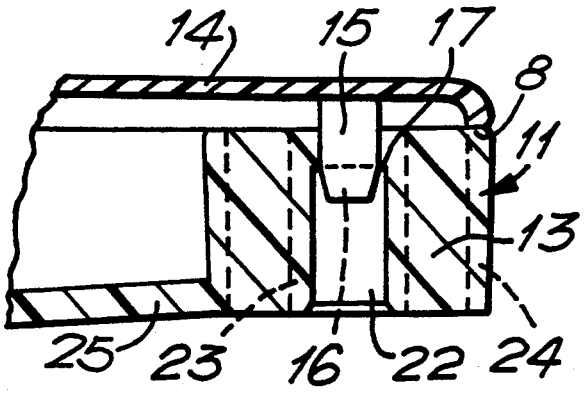
FIG. 3 is a sectional view on line B—B of FIG. 2.

The pedestal 1 shown in the drawings is a generally star-shaped chair base comprising a central boss or hub 2 defining an upright cylindrcial or tapered socket 10 from which extend five tapered supporting arms 11. The arms extend radially from the socket in equi-spaced relationship and in a plane normal to the axis of the socket 10, that is to say generally horizontally. Each arm 11 is formed at its outer or free end with a formation 3 which is part cylindrical in shape and which is pierced with a recess 22 of circular cross-section for receiving the carrying spindle or post (not shown) of a castor wheel 12. The arms 11 are moulded from plastics in one piece with the hub or boss 2 and are, except at their end portions in the region of the recesses 22, hollow and provided at intervals along their length with internal cross-bracing panels 4 for strengthening purposes. In cross-section the arms are of U-shaped configuration. At the outer or free end of each arm 11, the formation 3 has flat upper and lower surfaces defined by the ends of a central generally cylindrical boss 23 pierced with a generally vertical recess 22, an outer open-ended cylindrical wall 24 spaced from and co-axial with the boss 23 and a plurality of radial webs 13 connecting the boss 23 with the cylindrical wall 24 and extending parallel to the axis thereof. The recess 22 opens through the lower end of the boss 23 and communicates co-axially with a rectangular upper passageway 5 opening through the upper end of the boss and providing steps or abutment surfaces 17 at the junction of the recess and passageway. The arms 11 are provided at intervals along their length with further bosses 23 of similar formation to the boss described above but without the outer wall and radial webs. The internal cross-bracing panels 4 comprise longitudinally extending webs which interconnect said further bosses.

Figure 4:
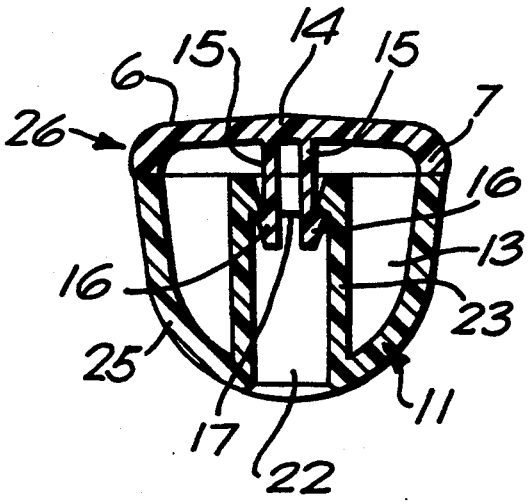
FIG. 4 is a sectional view on line C—C of FIG. 2.
Figure 5:
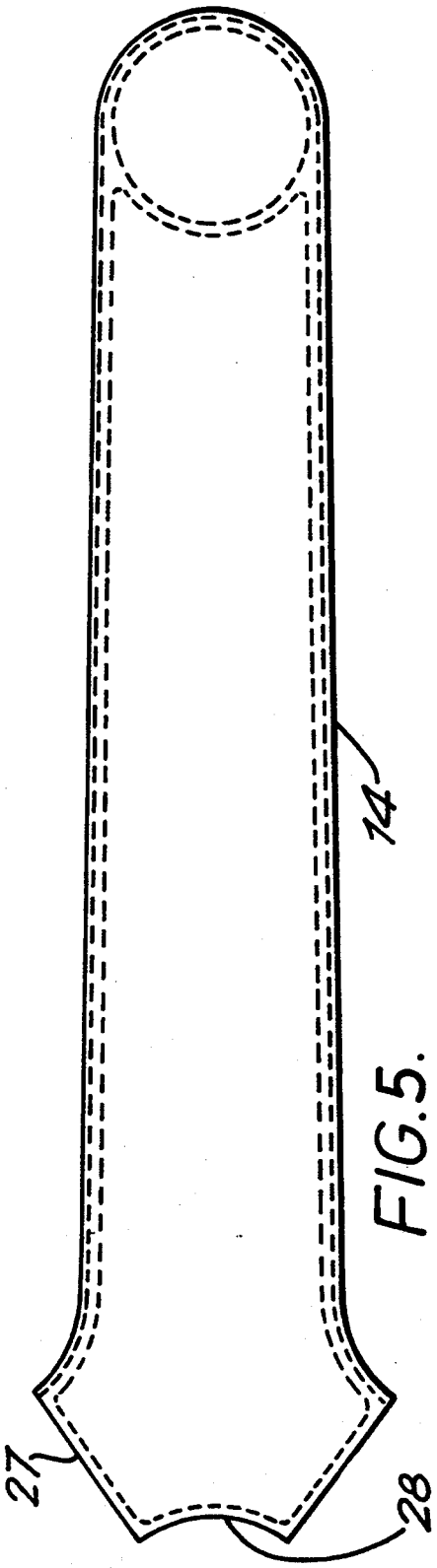
FIG. 5 is a plan view of a cover member or strip for an arm of the pedestal of FIG. 1.
Figure 6:
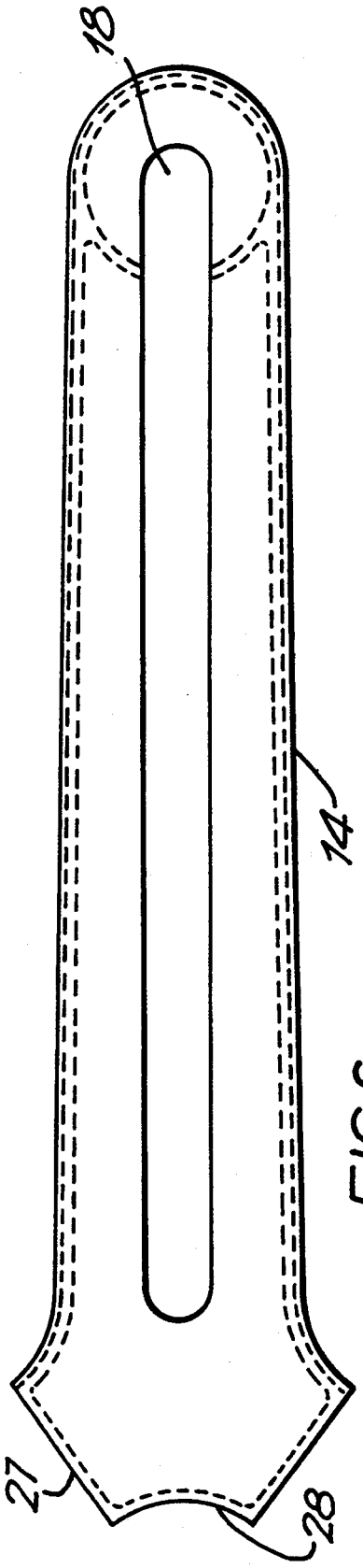
FIG. 6 is a plan view of an alternative form of main cover member strip for an arm of the pedestal of FIG. 1.
Figure 7:
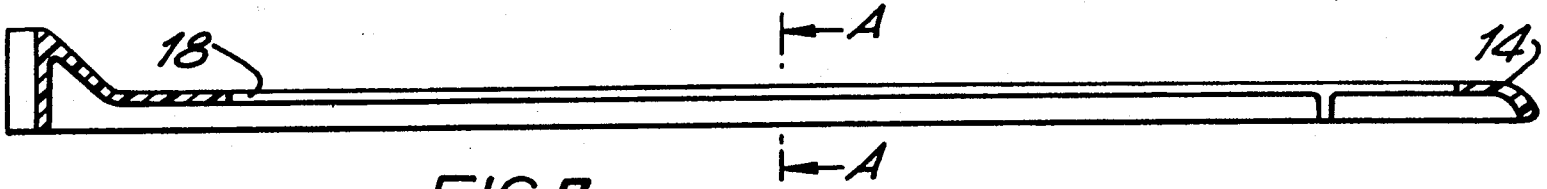
FIG. 7 is a cross sectional side view of the strip of FIG. 6.
Figure 8:
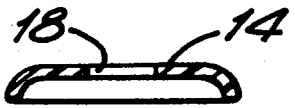
FIG. 8 is a cross sectional end view of the strip of FIG. 6 taken on the line A—A of FIG. 7.
Figure 9:
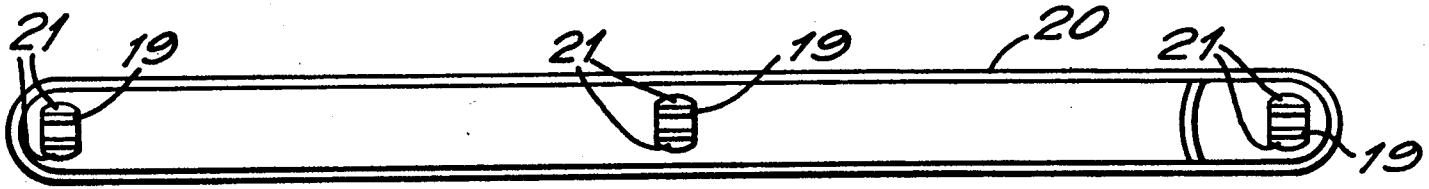
FIG. 9 is an underneath plan view of an upper or decorative strip.
Figure 10:
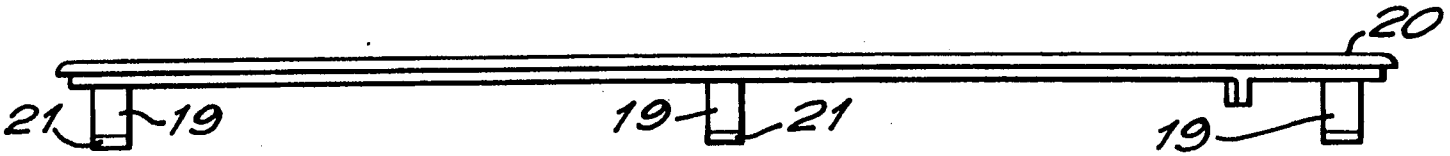
FIG. 10 is a side view of the strip of FIG. 9.

In cross section, as can be seen best in FIG. 4, each arm is smoothly rounded with a convex curve at its bottom 25 in contrast to known pedestals which tend to present sharp under-surfaces. Not only does a U-shaped pedestal present a pleasingly rounded smooth shape, it is also of optional strength and also prevents damage to the associated chair user's footwear. The upper edges 9 of the opposed sides of each arm define a top surface.

The hub 2 and arms 11 are moulded in one piece e.g. from plastics. The tops of the arms, which are open, are closed by separately moulded cover members or strips 14 which clip into position by pairs of integral, resilient, depending flanges 15 having detents 16 which project sideways and engage the abutment surfaces 17 in the bosses 23. The arms 11 may be provided with any desired ornamentation or decoration on the outer surfaces of their cover strips, for example in the form of thinner strips secured by adhesive.

As can best be seen in FIG. 4, the cover members or strips 14 comprise a top portion 6 and a pair of downwardly depending sides 7, the free or lower edges 8 of which define a bottom surface which is co-extensive with the top surface 9 of the arms. The junctions 26 between the top portions and the sides of each cover member 14 are smoothly convexly curved. The inner ends 27 of the cover members 14 are generally segmental in shape and are arranged to abut against others of the cover members on adjacent arms to cover the hub or boss 2 and are formed with part circular portions 28 to define together a generally circular aperture aligned with the socket 10 and similar in diameter so that when the chair post or column is received in the socket 10, it is snugly surrounded by the inner ends 27 of the cover members.

In an alternative arrangement shown in FIGS. 6 to 10 of the drawings, the cover strips 14, which are otherwise similar to those of FIGS. 1 to 5, do not themselves carry detents but are apertured at 18 to permit the passage of resilient projections 19 on upper strips 20, which projections have detents 21 engaging below abutment surfaces 17 in the arms 11, the upper strips 20 being wider than the apertures 18 in the strips 14 so that when the detents 21 engage below the abutment surfaces the assembly of strips and arms is held securely together. The upper strips may also provide any desired ornamental effect.

INDUSTRIAL APPLICABILITY

In use, the socket 10 contains an upright column, e.g. a tube or shaft, carrying a seat or other object.

Normally, the socket is conical and the bottom end the tube or shaft is correspondingly shaped so that it can be wedged in the socket.

Clearly it would be possible to mould a pedestal incorporating the teachings of the present invention in materials other than plastics, e.g. in metals such as aluminium. Also it would be possible to construct a pedestal in which the main part is made from one material, e.g. aluminium, and the cover parts are made from plastics, and vice versa.

I claim:

1. A pedestal comprising:

(a) socket means defining a socket for receiving a post;

(b) supporting means for supporting said socket means, said supporting means comprising a plurality of arms extending radially therefrom;

(c) at least one said arm being generally hollow, being generally U-shaped in cross-section, having a rounded bottom and having an opposite pair of sides having upper edges, said upper edges of said sides defining a top surface;

(d) an elongate opening in said top surface of said arm defined by said upper edges of said sides of said arm;

(e) a cover strip extending over said top surface of said arm; and (f) attachment means for attaching said cover strip to said arm, said attaching means extending into said opening and engaging the interior of said arm.

2. A pedestal according to claim 1, said hollow arms being of U-shape configuration and having a convexly curved bottom.

3. A pedestal comprising:

(a) socket means defining a socket for receiving a post;

(b) supporting means for supporting said socket means, said supporting means comprising a plurality of arms extending radially therefrom;

(c) at least one said arm being generally hollow, being generally U-shaped in cross-section, having a rounded bottom and having an opposite pair of sides having upper edges, said upper edges of said sides defining a top surface;

(d) an elongate opening in said top surface of said arm defined by said upper edges of said sides of said arm;

(e) a cover strip extending over said top surface of said arm; and (f) attachment means for attaching said cover strip to said arm, said attaching means extending through said open top surface and engaging said arm.

4. A pedestal comprising:

a hub formed with a socket for receiving an upstanding column;

a plurality of arms extending radially from the socket to support said socket on a floor, said hub and said arms being a moulded one piece structure, each said arm being hollow, being generally U-shaped in cross-section with a convexly curved bottom, and having an opposite pair of sides having upper edges defining a top surface, an a top opening, said top opening extending over substantially the whole length and width of each said arm between said upper edges; and separately formed cover members on top of said arms covering said top openings, each said cover member having a bottom surface, said bottom surfaces of said cover members and said top surfaces of said arms being co-extensive and abutting each other, and said cover members having inner and outer ends, said inner ends abutting one another to cover said hub and to define together an aperture aligned with said socket for snugly surrounding the upstanding column and through which the upstanding column projects.

5. A pedestal according to claim 1, wherein the one piece structure comprising the hub and supporting arms is moulded from plastics.

6. A pedestal according to claim 1, wherein the cover members are moulded from plastics.

7. A pedestal according to claim 1, comprising means for attaching said cover members to said arms, the attaching means being in the form of resilient projections having detents extending from said cover members, and said arms having abutments engaged by said detents to hold the cover members in place.

8. A pedestal according to claim 1, said pedestal having five arms.

9. A pedestal according to claim 1, wherein the free ends of the arms comprise formations defining recesses for receiving ground engaging castor wheels.

10. A pedestal according to claim 9, wherein each formation is part cylindrical in shape and is pierced with a cylindrical socket for receiving the upstanding post of a ground engaging castor wheel assembly.

11. A pedestal according to claim 4, wherein said cover members further each comprise a top portion and a pair of sides extending downwardly from said top portion, said top portion and said pair of sides having convexly curved junctions therebetween, said sides having lower edges, said lower edges defining said bottom surface of each said cover member.

12. A pedestal comprising:

a boss having a socket for receiving an upstanding column;

a plurality of substantially horizontal arms extending radially from said socket to support said socket on a floor, said boss and said supporting arms being a moulded one piece structure, said arms being hollow, being generally U-shaped in cross-section, and having convexly curved undersides and open tops defining elongate openings therein;

abutments in said arms;

separately formed cover strips over said tops of said arms and covering said openings, said cover strips having apertures therein; and upper strips over said cover strips, said upper strips having resilient projections extending through said apertures said projections having detents engaged under said abutments in said arms to hold said cover strips and said upper strips in place on said arms.

* * * * *